US005685584A

United States Patent [19]

Baren et al.

[11] Patent Number: 5,685,584

[45] Date of Patent: Nov. 11, 1997

[54] ADAPTOR SPINDLE

[75] Inventors: Andrew H. Baren, Golden's Bridge; Ian D. Baren, Hastings, both of N.Y.

[73] Assignee: Katonah Architectural Hardware, Katonah, N.Y.

[21] Appl. No.: 653,045

[22] Filed: May 24, 1996

[51] Int. Cl.[6] ..... E05B 3/00

[52] U.S. Cl. ..... 292/358; 292/348

[58] Field of Search ..... 292/358, 348, 292/350

[56] References Cited

U.S. PATENT DOCUMENTS

| | | | |
|---|---|---|---|
| 18,911 | 12/1857 | Kellogg | 292/348 |
| 294,881 | 3/1884 | Jones | 292/348 |
| 467,039 | 1/1892 | Mathesen | 292/358 |
| 481,519 | 8/1892 | Ashley | 292/348 |
| 714,466 | 11/1902 | Fader | 292/348 |
| 1,015,765 | 1/1912 | Spring | 292/358 |
| 1,308,325 | 7/1919 | Bird | 292/350 |
| 1,414,207 | 4/1922 | Reed | 292/348 |
| 1,970,758 | 8/1934 | Lyons et al. | 292/358 |
| 2,128,144 | 8/1938 | Heinen | 292/358 |
| 2,134,096 | 10/1938 | Andrie | 292/350 |
| 2,702,204 | 2/1955 | Collier | 292/358 |
| 4,123,097 | 10/1978 | Allemann | 292/336.3 |
| 4,183,565 | 1/1980 | Allemann | 292/163 |
| 4,667,994 | 5/1987 | Foshee | 292/358 |
| 4,728,133 | 3/1988 | Valley | 292/350 |

FOREIGN PATENT DOCUMENTS

| | | | |
|---|---|---|---|
| 102476 | 11/1937 | Australia | 292/348 |
| 614908 | 5/1935 | Germany | 292/358 |
| 698038 | 11/1965 | Italy | 292/358 |
| 1013 | 1/1913 | United Kingdom | 292/358 |

*Primary Examiner*—Rodney M. Lindsey
*Attorney, Agent, or Firm*—Anthony J. Cassella; Gerald E. Hespos; Ludomir A. Budzyn

[57] ABSTRACT

An adaptor spindle having a square cross-sectional center, dimensioned to fit and operate a standard European lock set, eight-sided opposed ends, formed to accept standard American door knobs and levers, and a tension pin, for centering the adaptor spindle in the lock set during assembly and for preventing tampering with the lock set.

12 Claims, 3 Drawing Sheets

ADAPTOR SPINDLE

BACKGROUND OF THE INVENTION

1. Field of the Invention

This invention relates to door hardware, and more particularly to an adaptor spindle which can be used in a standard European lock set and can receive standard American door trim.

2. Description of the Prior Art

Door hardware, outside of the hinges, typically consists of a lock set, used to secure a door, and trim, such as a knob or lever, to operate the lock set. As an example of the prior art, reference is made to FIG. 1 which shows a common lock set and trim combination. The trim 40 is attached to a spindle 10, which protrudes from both sides of the lock set 20, with set screws 30. Some spindle and trim combinations have cooperating threads which require the trim to be mounted and rotationally tightened onto the spindle, prior to the tightening of the set screw.

Lock set spindles have been standardized in the United States and in Europe, allowing the use of different trim with different lock sets. These standards, however, are different on opposite sides of the ocean. In the United States, a spindle has a square cross-section with each side measuring 7 mm. The spindle at rest, without any applied torsional force, has the shape of a diamond when looking along the axis of the spindle. This configuration is known as "7 mm. on the diamond" and is depicted in FIG. 2, with spindle 10 having sides measuring dimension "A", each with a length of 7 mm. Door trim in the United States is manufactured to engage the 7 mm. on the diamond standard (hereinafter "American trim"). In contrast, spindles used in European lock sets have a square cross-section with each face being 8 mm. in length. The European spindle at rest has its cross-section in an upright position revealing the profile of a square. As shown in FIG. 3, spindle 15 has four sides corresponding with dimension "B", each measuring 8 mm. The European standard is known as "8 mm. on the square".

Americans also use a different type of lock set than Europeans on exterior doors in a construction. The typical American lock set is of the one attachment point variety. In other words, the lock set only fastens the door at one location —that location being where the locking mechanism of the lock set enters into the door frame. In contrast, exterior doors in Europe commonly have three point or five point attachment lock sets (hereinafter "European lock sets"). These lock sets secure the door in three or five places, respectively. FIG. 4 depicts a three point European lock set. As shown in FIG. 4, the lever 50 operates all three locking mechanisms 51, 52 and 53. The median locking mechanism 52 functions in a manner similar to a one point locking set; the turning of the lever 50 causes the attached spindle to turn and urges the sliding component of the lock set into the door 55. The locking mechanisms 51 and 53 at the ends of the door use rotational motion to operate. This rotational motion is provided by members 60, 61 mounted on the door 55 which transmit the rotational motion of the median locking mechanism 52 to the outer locking mechanisms 51, 53. A five point attachment lock set works in a similar manner, except five locking mechanisms are provided, all operated by the rotational motion applied to the lever attached to the median locking mechanism.

There is a demand for European lock sets since a multiple-point fastened door seals tighter than a door with a one point attachment lock set. The better securement results in less warpage of the door and sounder thermal protection through reduction of heat or air conditioning leakage around the door. In many new constructions in the United States, European lock sets are being installed on external doors. Unfortunately, American trim, which would match the trim customarily used in the rest of the construction, cannot be utilized on the external doors having European lock sets, due to the dimensional differences of the American trim, built for the 7 mm. on the diamond spindle, and European lock set spindle. The result is an unattractive inconsistency in the external door hardware and the trim found in the rest of the construction. As a result of this unsatisfactory situation, there is a need for an adaptor spindle which can be used in a European lock set with American trim.

Also, American trim comes in a much broader range of varieties and styles, as compared with European trim. Europeans, who seek to replace old European trim, will be unable to take advantage of the broad American trim market without replacing European lock sets. To allow Europeans a wider range of door trim, there is a need for an adaptor spindle which allows for the use of American trim with a European lock set.

Also, lock set spindles are required to fulfill several practical functions. First, the spindle must be able to transmit a rotational force from a knob or lever to the lock set. Second, the spindle has to accept set screws, needed to fasten the trim to the spindle. Third, the spindle should be able to accept threaded or unthreaded trim. Fourth, the spindle should be easily centered in the lock set during assembly. Fifth, the spindle is required to prevent tampering with the lock set. The spindle should prevent a party from being able to remove the trim on one side of the lock set and being able to push or pull the spindle through the lock set. Thus, there is a need for an adaptor spindle to be used in a European lock set, accept American trim, and fulfill the practical functions required of a lock set spindle.

SUMMARY OF THE INVENTION

It is an object of the present invention to provide an adaptor spindle for connecting standard American door trim to standard European lock sets and capable of fulfilling the practical functions required of a lock set spindle.

Another object of this invention is to provide an adaptor spindle capable of transmitting rotational force from a knob or lever to the lock set.

Also, an object of this invention is to provide an adaptor spindle which is able to accept set screws, needed for mounting the trim onto the adaptor spindle.

Yet, another object of the invention is to provide an adaptor spindle capable of accepting threaded and unthreaded trim.

It is also an object of this invention to provide an adaptor spindle which centers in a lock set during assembly.

Also, an object of this invention is to provide an adaptor spindle which prevents tampering with an assembled lock set.

The above mentioned objects of the present invention are achieved by an adaptor spindle comprising an external member, an internal member, and a tension pin. In the preferred embodiment, the adaptor spindle comprises an internal member and an external member formed as one piece. In an alternative embodiment, the adaptor spindle comprises a separate external member and a separate internal member, where the internal member is bored out so that a machine screw can pass and fasten both members together.

The internal member and external member are both formed from metal having an 8 mm. square cross-section.

Four elongated slats are milled onto both members at about 45° to the sides of the members, each slat being opposite another at a distance of approximately 7 mm. The slats extend from one end of each member to a pre-determined point along the length of the member, thus leaving the members with an eight-sided profile from one end and a four-sided profile from another. The eight-sided end of each member is capable of receiving American trim having the 7 mm. on the diamond standard, with each slat corresponding to one side of the 7 mm. diamond. The square end of each member is capable of operating a European lock set with the 8 mm. on the square standard. Thus, one feature of this invention allows the adaptor spindle to be used in a European lock set with American trim.

Another feature of the new and improved adaptor spindle of the subject invention is the ability of the adaptor spindle to transmit torque from the connected trim to the lock set: The preferred embodiment comprises a unitary piece which is sufficiently strong to transmit the torque normally generated in operating a lock set. The alternative embodiment of the new and improved adaptor spindle of the subject invention calls for the internal member and external member to have a mating combination of groove and key members at the point of fastening of the two members. The groove and key members together act as a means for transmitting and receiving torsional force between both members, the trim and the lock set.

The new and improved adaptor spindle of the subject invention also calls for the eight-sided ends of each member to have a slot milled into a single slat. These slots act as receptacles into which a set screw of a knob or lever can be tightened.

Yet another feature of the new and improved adaptor spindle of the subject invention allows the use of American threaded and unthreaded door trim. Both these types of trim will be able to slide onto the eight-sided ends of the adaptor spindle being disclosed.

The new and improved adaptor spindle of the subject invention also has a tension pin protruding from opposite sides of the four-sided end of the external member. This tension pin has a two-fold purpose. First, the pin serves as a centering means for the adaptor spindle. The pin will press against a retaining means, located in a lock set, when the adaptor spindle has been sufficiently inserted into the lock set. The tension pin is located on the external member so that at the point of contact with the retaining means, the center of the adaptor spindle will be aligned with the center of the lock set. Second, the tension pin prevents a party from improperly removing the adaptor spindle. A party who removes the knob or lever on the external side of the lock set will not be able to push the adaptor spindle through the lock set due to the contact between the tension pin and the lock set retaining means. Furthermore, the party cannot pull the adaptor spindle from the lock set because trim, which would be in place on the internal side of the lock set, would prohibit such removal.

These and other features of the invention will be better understood through a study of the following detailed description of the invention and the accompanying drawings.

DETAILED DESCRIPTION OF THE PREFERRED EMBODIMENTS

Figure 5:
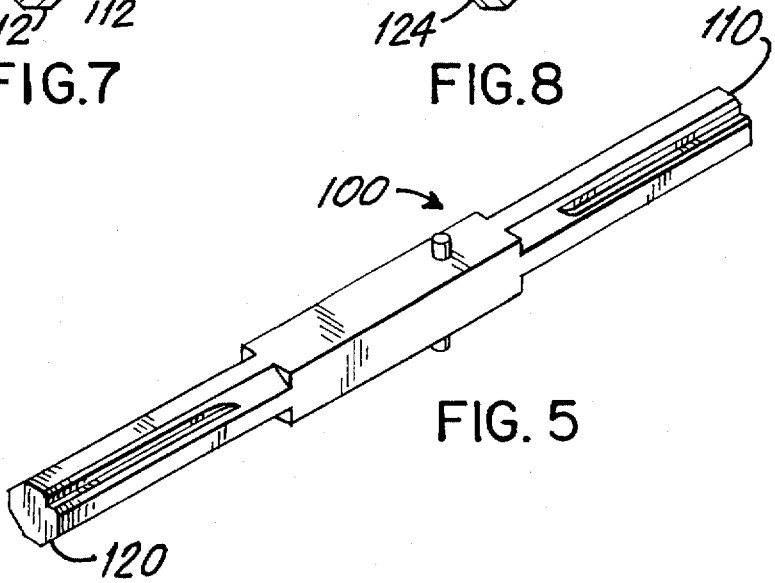
FIG. 5 is a perspective view of the preferred embodiment of the new and improved adaptor spindle of the subject invention.
Figure 9:
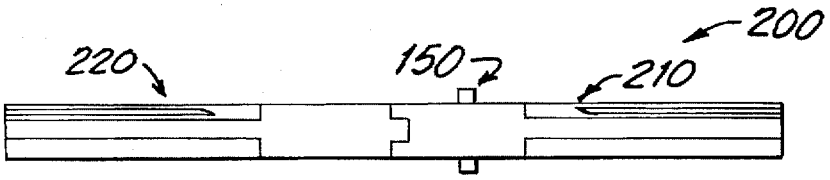
FIG. 9 is a plan view showing an alternative embodiment of the new and improved adaptor spindle of the subject invention.

Referring to FIG. 5, the new and improved adaptor spindle of the subject invention is designated by the numeral 100 and is for use with European lock sets and American door trim. The adaptor spindle 100 comprises two members, an external member 110 and an internal member 120. As FIG. 6 shows, the two members are formed from a single piece.

Figure 1:
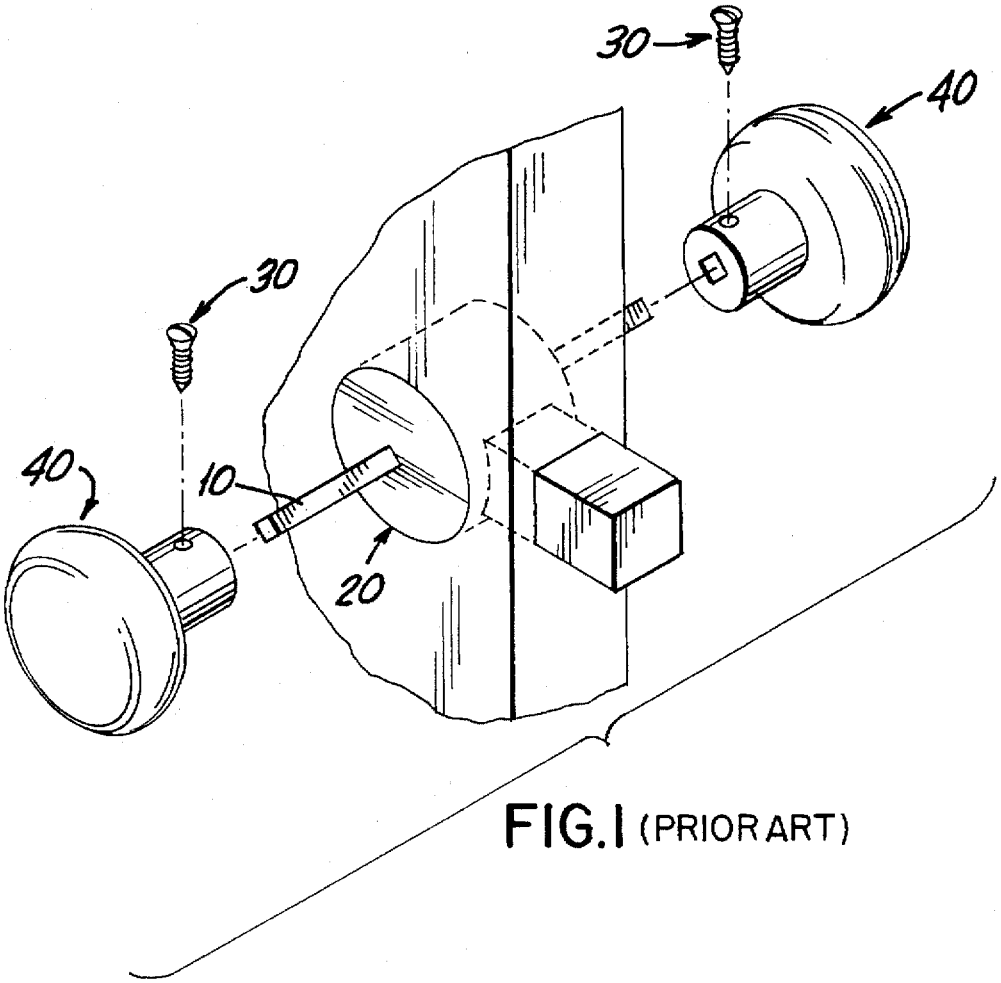
FIG.1 (PRIOR ART)
FIG. 1 is a cut-away view of a prior art lock set and trim combination.
Figure 2:
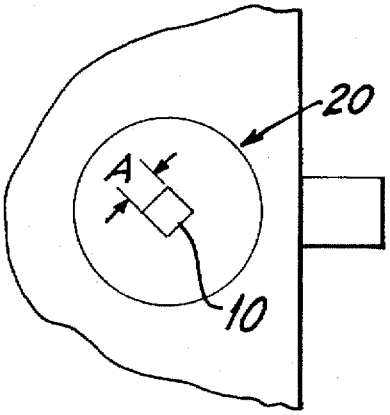
(PRIOR ART) FIG.2
FIG. 2 is a schematic view of a prior art American spindle.
Figure 3:
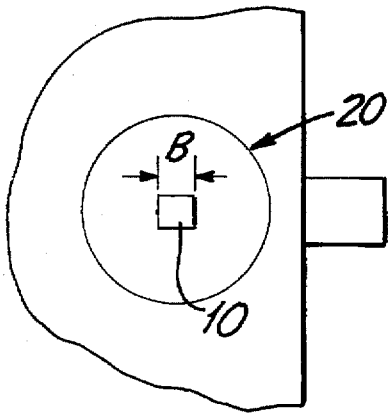
(PRIOR ART) FIG.3
FIG. 3 is a schematic view of a prior art European spindle.
Figure 4:
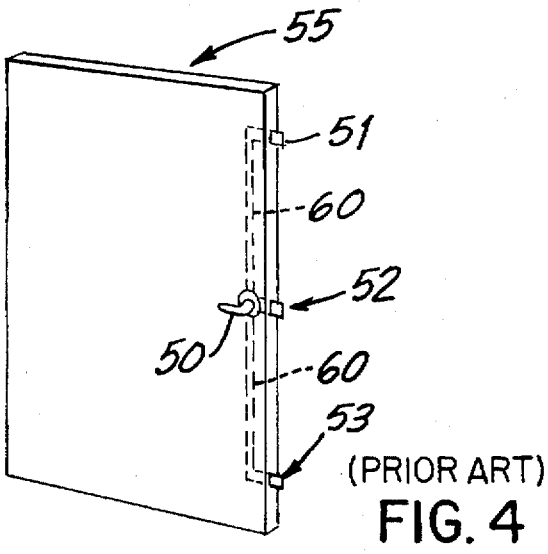
FIG. 4 is a schematic view of a door with a prior art three-point European lock set.
Figure 6:
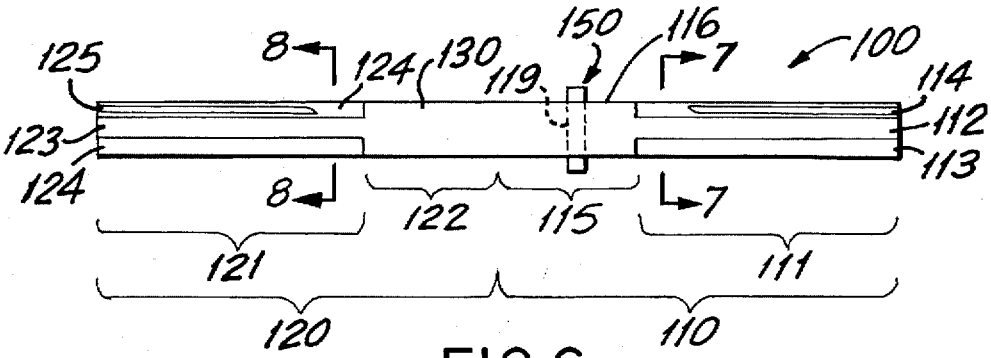
FIG. 6 is a plan view of the preferred embodiment of the new and improved adaptor spindle of the subject invention.
Figure 7:
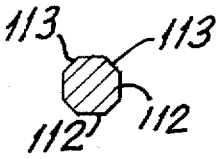
FIG. 7 is a cross-sectional view of the external member taken along line 7—7 in FIG. 6.
Figure 8:
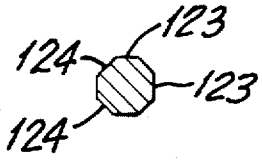
FIG. 8 is a cross-sectional view of the internal member taken along line 8—8 in FIG. 6.

Referring to FIGS. 6–8, the external member 110 comprises two portions, a lever engaging portion 111 and a lock set engaging portion 115. The lever engaging portion 111 is formed to define eight surfaces, four faces 112 and four slats 113. FIG. 7 depicts the cross-section of the lever engaging portion 111 and shows the faces 112 and the slats 113. The slats 113 are machined at 45° to the faces 112 where opposed slats are approximately 7 mm. apart. The lever engaging portion 111 also has a slot 114 milled into one of the slats 113. The slot 114 is for receiving the set screw of the trim being mounted onto the adaptor spindle 100. The lock set engaging portion 115 is formed to be substantially a square having sides 116 measuring substantially 8 mm each, dimensioned for use with a European standard lock set. The lock set engaging portion 115 also has a tension pin aperture 119 drilled between opposing sides 116.

A tension pin 150, which may be formed by bending a piece of metal into substantially the shape of a cylinder, is placed into the tension pin aperture 119. As seen in FIG. 6, the tension pin 150 has a length greater than the lock set engaging portion 115, with both ends of the tension pin 150 protruding from the sides 116 of the lock set engaging portion 115.

The internal member 120 also has a lever engaging portion 121 and a lock set engaging portion 122. The cross-section of the internal member lever engaging portion 121 is similar to that of the external member lever engaging portion 111. As can be seen by FIG. 8, four faces 123 and four slats 124 make up the profile of the lever engaging portion 121. The faces 123 and slats 124 are spaced in the same manner as the faces 112 and the slats 113 of the external member lever engaging portion 111. A slot 125 is milled into one of the slats 124 in the lever engaging portion 121. The lock set engaging portion 122 has four sides 130 which are shaped and dimensioned similarly to the sides 116 of the lock set engaging portion 111 of the external member 110.

By this arrangement, the lock set engaging portions 115, 122 have sides 116, 130, respectively, which are dimensioned to cooperate with a European lock set. Each side 116, 130, corresponds to one 8 mm. side of the square profile of a European spindle. Also lever engaging portions 111, 121 correspond to the dimensions of a standard American spindle and are capable of cooperating with American trim. Faces 112, 123 are each formed to correspond to one side of the American diamond configuration. Thus, the adaptor spindle is capable of simultaneously engaging a European lock set and American trim.

In operation, the internal member 120 of the adaptor spindle 100 is inserted into a European lock set from the side corresponding to the external portion of the door. The internal member 120 is inserted to the point where the tension pin 150 comes into contact with the retaining means of the lock set. The four sides 116 of the external member lock set engaging portion 115 and the four sides 130 of the internal member lock set engaging portion 122 engage the European lock set. American trim can be attached to both lever engaging portions 111,121 of the adaptor spindle 100 by fastening set screws into the external member slot 114 and the internal member slot 125.

Figure 10:
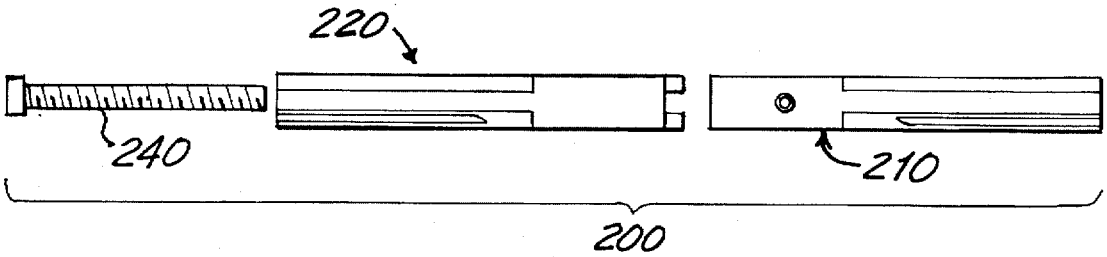
FIG. 10 is a plan view of the assembly of the alternative embodiment of the spindle.
Figure 11:
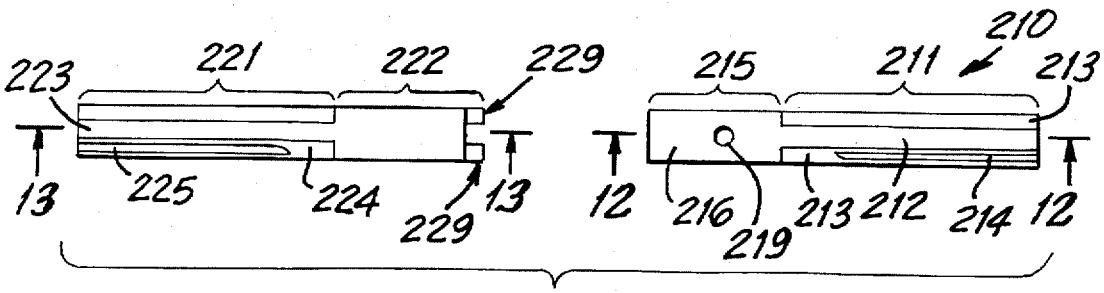
FIG. 11 is a plan view of the internal member and external member of the spindle.

FIGS. 9–13 show an alternative embodiment of an adaptor spindle 200 for use with European lock sets and American door trim. The spindle 200 comprises two members, an external member 210 and an internal member 220. As FIG. 10 shows, the two members are fastened by a machine screw 240.

The external member 210 comprises two portions, as seen in FIG. 10, a lever engaging portion 211 and a lock set engaging portion 215, which are configured similarly to the lever engaging portion 111 and lock set engaging portion 115, respectively. The lever engaging portion 211 has four faces 212, four slats 213, and a slot 214 milled into one of the slats 213, which is for receiving the set screw of the trim being mounted onto the adaptor spindle 200.

Figure 12:
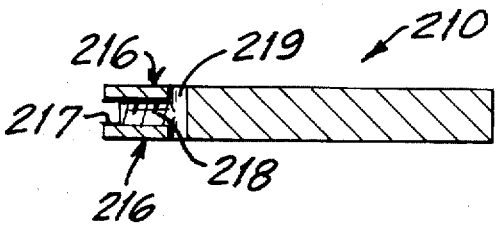
FIG. 12 is a cross-sectional view of the external member taken along line 12—12 in FIG. 11.

The lock set engaging portion 215 has four sides 216 defining the 8 mm. on the square profile. A groove 217 is milled into the lock set engaging portion 215. In the center of the groove 217, as FIG. 12 shows, a bore 218, dimensioned and threaded to mate with the machine screw 240, is located. The lock set engaging portion 215 also has a tension pin aperture 219. The tension pin 150 can be placed into the tension pin aperture 219.

Figure 13:
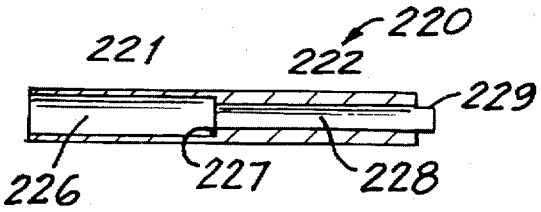
FIG. 13 is a cross-sectional view of the internal member taken along line 13—13 in FIG. 11.

The internal member 220 has a lever engaging portion 221 and a lock set engaging portion 222. The cross-section of the internal member lever engaging portion 221 is similar to that of the internal member lever engaging portion 121 with faces 223 and slats 224. A slot 225 is milled into one of the slats 224. The lever engaging portion 221, is however, bored out, as shown in FIG. 13 by boring 226. The boring 226 runs the full length of the lever engaging portion 221. Where the lever engaging portion 221 meets the lock set engaging portion 222, a retainer wall 227 is formed, as seen in FIG. 15 surrounding a retaining portion 228. The retaining portion 228 is dimensioned to accept the machine screw 240, with the retainer wall 227 as a means for receiving the head of the machine screw 240.

The lock set engaging portion 222 is shaped and dimensioned similarly to the lock set engaging portion 122. However, the lock set engaging portion 222 has an end defining two key members 229. The key members 229 are formed to engage with the groove 217. Together the groove 217 and the key members 229 act to transmit and receive torque between the external member 210 and the internal member 220. Between the key members 229, the retaining portion 228 forms an opening.

Once assembled, the adaptor spindle 200 has the same configuration as the adaptor spindle 100. With this configuration, the adaptor spindle 200 is capable of simultaneously cooperating with American trim and a European lock set.

In operation, the internal member 220 and the external member 210 are assembled to form the adaptor spindle 200 with the key members 229 and the groove 217 in mating engagement. The machine screw 240 is then inserted into the boring 226 of the internal member so that the end of the machine screw 240 passes through the retaining portion 228 and into the bore 218, where the threads of the screw and bore interengage. The machine screw 240 is tightened until the head of the machine screw 240 comes in contact with the retainer wall 227. The internal member 220 is then inserted into the European lock set from the side corresponding to the external portion of the door to the point where the tension pin 150 comes into contact with the retaining means of the lock set. Trim can be attached to both sides of the adaptor spindle 200 by fastening set screws into the external member slot 214 and the internal member slot 225.

Accordingly, there is provided a new and improved adaptor spindle for use with European lock sets and American trim. As is readily apparent, numerous modifications and changes may readily occur to those skilled in the art, and hence it is not desired to limit the invention to the exact construction and operation shown and described, and accordingly all suitable modification equivalents may be resorted to falling within the scope of the invention as claimed.

What is claimed is:

1. An adaptor spindle for transmitting rotational force from American door trim mounted on at least one end of said spindle to an European lock set engaged by said spindle, said European lock set having an inner surface with four planar channel walls defining a spindle receiving channel cross-sectionally formed with a square profile, said American door trim having an inner surface with four planar inner walls defining a spindle receiving recess cross-sectionally formed with a diamond profile, said spindle comprising an elongated body with opposing end portions and a central portion therebetween, said end portions each formed with planar faces which cross-sectionally define an eight-sided polygon, and said central portion having four planar sides which cross-sectionally define a square profile, wherein each said end portion is formed to engage said American door trim with four of said eight planar faces engaging said inner walls of said American door trim in planar face-to-face engagement, and wherein said central portion is formed to engage said European lock set with said four planar sides engaging said channel walls of said European lock set in planar face-to-face engagement, whereby the respective face-to-face engagements of said planar faces with said inner walls of said American door trim prevent rotation of said American door trim relative to said spindle, and whereby the respective face-to-face engagements of said planar sides with said channel walls of said European lock set prevent rotation of said spindle relative to said European lock set with said spindle being formed to rotate with said American door trim and transmit rotational force to said European lock set.

2. An adaptor spindle as in claim 1, wherein said end portions comprise slots.

3. An adaptor spindle as in claim 1, wherein said central portion defines surfaces having opposed points at a distance of substantially 8 mm.

4. An adaptor spindle as in claim 1, wherein said end portions are each formed to define surfaces having opposed points at a distance of substantially 7 mm.

5. An adaptor spindle as in claim 1, wherein the adaptor spindle further comprises a tension pin.

6. An adaptor spindle for transmitting rotational force from American door trim mounted on at least one end of said spindle to a European lock set engaged by said spindle, said European lock set having an inner surface with four planar channel walls defining a spindle receiving channel cross-sectionally formed with a square profile, said American door trim having an inner surface with four planar inner walls defining a spindle receiving recess cross-sectionally formed with a diamond profile, said spindle comprising two elongated members each formed with opposing end portions, one end portion of each said member being formed with eight planar faces which cross-sectionally define an eight-sided polygon profile, and said opposing end portion of each said member having four planar sides which cross-sectionally define a square profile, said members being joined with said square ends being in abutting contact, wherein each said eight-sided polygon end is formed to engage said American door trim with four of said eight planar faces engaging said inner walls of said American door trim in planar face-to-face engagement, and wherein said square ends are collectively formed to engage said European lock set with said four planar sides engaging said channel walls of said European lock set in planar face-to-face engagement, whereby the respective face-to-face engagements of said planar faces with said inner walls of said American door trim prevent rotation of said American door trim relative to said spindle, and whereby the respective face-to-face engagements of said planar faces with said channel walls of said European lock set prevent rotation of said spindle relative to said European lock set with said spindle being formed to rotate with said American door trim and transmit rotational force to said European lock set.

7. An adaptor spindle as in claim 6, wherein the members have interlocking means for transmitting and receiving torque between the members during operation of the lock set.

8. An adaptor spindle as in claim 6, wherein the adaptor spindle further comprises a fastening means for joining said members.

9. An adaptor spindle as in claim 6, wherein the eight-sided polygon ends of the members comprise slots.

10. An adaptor spindle as in claim 6, wherein the adaptor spindle further comprises a tension pin.

11. An adaptor spindle as in claim 6, wherein the square ends of the members are each formed to define surfaces having opposed points at a distance of substantially 8 mm.

12. An adaptor spindle as in claim 6, wherein the eight-sided polygon ends of the members are each formed to define surfaces having opposed points at a distance of substantially 7 mm.

* * * * *